United States Patent [19]

Lancaster

[11] Patent Number: 4,593,518

[45] Date of Patent: Jun. 10, 1986

[54] FLEXIBLE WRAPPING APPARATUS

[75] Inventor: William G. Lancaster, Louisville, Ky.

[73] Assignee: Lantech, Inc., Louisville, Ky.

[21] Appl. No.: 523,975

[22] Filed: Aug. 17, 1983

[51] Int. Cl.[4] ..... B65B 13/12

[52] U.S. Cl. ..... 53/556; 53/210; 53/588

[58] Field of Search ..... 53/203, 210, 261, 262, 53/399, 441, 556, 574, 575, 576, 587, 588, 591; 100/27; 493/300, 302

[56] References Cited

U.S. PATENT DOCUMENTS

| | | | |
|---|---|---|---|
| 1,218,314 | 3/1917 | Read | 53/262 X |
| 4,050,220 | 9/1977 | Lancaster et al. | 53/588 X |
| 4,178,734 | 12/1979 | Lancaster et al. | 53/399 |
| 4,302,920 | 12/1981 | Lancaster et al. | 53/441 X |
| 4,317,322 | 3/1982 | Lancaster et al. | 53/588 X |

*Primary Examiner*—Robert L. Spruill
*Assistant Examiner*—Michael D. Folkerts
*Attorney, Agent, or Firm*—Gipple & Hale

[57] ABSTRACT

The invention comprises a novel apparatus having a plurality of flexible members which extend downstream horizontally along a wrapping conveying assembly for making unitary packages which are wrapped on all sides. The apparatus is particularly adapted for wrapping of loads with lengths and circumferences which vary substantially from one load to the next. Film is wrapped around the load, the flexible members and the conveying assembly with the load being carried off by another conveyor. The flexible members extend from the load being wrapped to the previous load which has been wrapped so that the stretched film is wrapped around the flexible member between loads causing the flexible members to be pulled inward forming a configuration resembling an hour glass. As the loads are being continuous bundled, the wrapped bundles can be transported downstream to a cutting and sealing area where the wrap is severed and optionally sealed forming individually enclosed wrapped packages.

18 Claims, 4 Drawing Figures

FLEXIBLE WRAPPING APPARATUS

BACKGROUND OF THE INVENTION

The present invention generally relates to packaging and more particularly is directed to a rotating stretch wrapping apparatus and method for making unitary packages which hold a plurality of components, each package containing a load wrapped on all sides by a web of stretched film.

Case packing or boxing is a common way of shipping multiple unit products which need to be enclosed. Multiple unit products are generally stacked in a corrugated box or are wrapped with kraft paper with the ends of the kraft paper being glued or taped.

Some manufacturers use steel or plastic strapping to unitize the product. The problems incurred in the use of strapping are the requirement of costly corner protectors, danger of bending or snapping and possible injury to the operator while applying this high tension material to the loads. In addition there is the ever present problem of settling due to moisture wetting the cartons, and the sides of the cartons bulging or normal vibrations causing the straps to loosen and the load to come apart.

Glue is an alternative method for some packaging usages but customer dissatisfaction with gluing is high because removal of glued cartons or bags from the unitized loads tends to tear outside layers of the cartons. Glue, although an inexpensive material, demands interleaving for product orientation requiring more durable and expensive packaging material.

Because of the lack of alternatives of packaging, tape is currently being used to horizontally bind the top layer of the load. However, tape is expensive and allows relatively free movement of all product surrounded.

Another way of shipping products is by putting a sleeve or covering of heat shrinkable material around the products and shrinking the sleeve to form a unitized package. The use of heat shrinkable film is described in U.S. Pat. Nos. 3,793,798; 3,626,654; 3,590,549; and 3,514,920. A discussion of this art is set forth in U.S. Pat. No. 3,867,806.

The present invention is designed to function with stretchable film webs of plastic material such as nylon, polypropylene, PVC, polybutylene, polyethylene or any copolymer or blends of the aforementioned stretchable films.

An economical way of packaging products currently being used is by wrapping the product load with a web of stretched plastic film.

The elasticity of the stretched plastic film holds the product of the load under more tension than either shrink wrap or kraft wrap, particularly with products which settle when packaged. The effectiveness of stretched plastic film in holding a load together is a function of the containment or stretch force being placed on the load and the ultimate strength of the total layered film wrap. The strength is determined by the modulus or hardness of the film after stretch has occurred and the containment force is currently achieved by maximizing elongation until just below a critical point where breaking of the film occurs.

The use of wrapping machinery to wrap stretched film around a load is well known in the art. Four types of stretch wrapping apparatus are commonly used in the packaging industry and these types are generally described as spiral rotary machines, full web rotary machines, pass-through machines, and circular rotating machines.

A spiral machine is shown in U.S. Pat. No. 3,863,425 in which film is guided from a roll and wrapped around a cylindrical load in a spiral configuration. A carriage drives the film roll adjacent the surface of the load to deposit a spiral wrap around the load and returns in the opposite direction to deposit another spiral overwrap around the load.

In U.S. Pat. No. 3,788,199, tapes are spirally wound in such a manner that they overlap each other to provide suitable space therebetween when breatheability is required. In this disclosure, a heavy duty bag is prepared by spirally winding stretched tapes of synthetic resin in opposite directions, so that they intersect each other to form a plurality of superimposed cylindrical bodies which are bonded together to form a cylindrical network. The spirally wound inner and outer tapes of the superimposed cylindrical body intersect each other at a suitable angle, depending upon the application intended, the preferred embodiment having substantially equal longitudinal transfer strength. In the preferred embodiment, the tapes intersect each other at an angle of about 90 degrees. The angle defined by the tapes constituting the cylindrical network may be determined by varying the interrelationship between the travelling speed of the endless belts carrying the tape and the rotating speed of the bobbin holders, which rotates a plurality of tape bobbins to deposit the tape onto the moveable belt.

Spiral wrapping machines which are currently commercially available are manufactured by Lantech, Inc. under Model Numbers SVS-80, SVSM-80, STVS-80, STVSM-80 and SAHS-80.

A full web type of apparatus which wraps stretched film around a rotating load is disclosed in U.S. Pat. No. 3,867,806 assigned to Lantech, Inc. A similar full web apparatus using a tensioned cling film wrapped around a rotating load is shown by U.S. Pat. No. 3,986,611 while another apparatus using a tacky PVC film is disclosed in U.S. Pat. No. 3,795,086.

Full web wrapping machines typical of those presently commercially available are Model Numbers S-65, T-65, and SAH-70 manufactured by Lantech, Inc.

Another type of machine for wrapping a pallet load commonly called a pass-through machine is disclosed in U.S. Pat. No. 3,596,434. In this reference a pallet load is transported along a conveyor and the leading face of the pallet load contacts a vertical curtain of film formed by the sealed leading edges of film webs dispensed by two rolls of film on opposite sides of the path of the pallet load. The pallet load continues to move along the conveyor, carrying with it the sealed film curtain until the two side faces of the pallet load as well as the front face are covered by film web. A pair of clamping jaws then close behind the pallet load, bringing the two film web portions trailing from the side faces of the pallet load into contact with one another behind the pallet. The jaws then seal the film web portions together along two vertical lines, and cut the web portions between those two seals. Thus, the film web portions are connected to cover the trailing face of the pallet load, and the film curtain across the conveyor is re-established to receive the next pallet load. The pallet load may subsequently be exposed to heat in order to shrink the film web and apply unitizing tension to the load, as is disclosed in U.S. Pat. No. 3,662,512. Another disclosure of relevance to pass-through wrapping is U.S. Pat. No.

3,640,048 which shows that film may be applied to the top and bottom of the pallet load prior to the wrapping cycle when it is desired to cover all six surfaces of the pallet load with film. Commercial pass-through machines are currently manufactured by Weldotron, Arenco, and SAT of France.

Various apparatus and processes have been developed to rotatably wrap stacked components to form a load.

Stationary loads which are brought to a loading area and are wrapped by a rotating member which dispenses stretched film around a load are disclosed in U.S. Pat. Nos. 4,079,565 and 4,109,445. U.S. Pat. No. 4,079,565 discloses a full web vertical wrap of a load while U.S. Pat. No. 4,109,455 discloses a horizontal spiral wrap of a load.

U.S. Pat. No. 4,050,220 discloses a wrapping device for multiple unit loads. Each load is conveyed to a wrapping area in which a load is supported on one or more stationary planar surfaces. The leading edge of a roll of stretchable plastic wrapping material is held adjacent to the load, and the roll of material is rotated about the load and the supporting planar surfaces, wrapping the load and the supporting surfaces together. Plastic wrapping material is stretched during the wrapping operation so that the material is under tension when applied to the load. After the wrapping cycle is complete, the load is pushed past the ends of the supporting surfaces, and the wrapping material which covered the supporting surfaces collapses against the supported sides of the load. Further developments of this type of wrapping system are disclosed in U.S. Pat. Nos. 4,110,957 and 4,178,734.

U.S. Pat. No. 603,585 discloses a spiral wrapping device for enclosing individual newspapers in paper wrap for mailing purposes. Each newspaper is placed on a cylindrical core with a circumference approximately twice that of a newspaper, and each newspaper advances along the length of the core as the core is rotated. Wrapping paper is applied to the core at an angle and the wrapping paper trailing each newspaper is severed as each newspaper reaches the end of the cylinder and is placed on a flat horizontal surface, thereby collapsing the wrapping paper against the underside of the newspaper previously pressed to the cylinder.

U.S. Pat. No. 1,417,591 discloses a wrapping machine for individual items such as boxes in which each such item is conveyed along the surface of a horizontal sheet of wrapping material. The edges of wrapping material on each side of an item are curled upward to meet one another atop the item to be wrapped thereby forming a tube around the item. The leading end of the tube is sealed and the trailing end of the tube is severed and then sealed to enclose the item. Another device which utilizes this system of wrapping is disclosed in U.S. Pat. No. 3,473,288.

In U.S. Pat. No. 2,575,467, a wrapper of cylindrical packages for material such as sausage is disclosed in which the package is rotated about its cylindrical axis as wrapping tape is applied at an angle to form a cylindrical wrap.

In U.S. Pat. No. 2,863,270, two cylindrical items of approximately equal diameter are abutted at their planar ends, and placed by hand in a cradle which exposes the complete circumference of the abutting ends. A roll of wrapping material is then driven by a hand crank mechanism to circulate around the circumference of the abutting ends, applying wrapping material thereto. When sealed together, the pair of cylindrical items are removed from the cradle by hand.

A spiral wrapping machine for long bundles of items such as filaments is disclosed in U.S. Pat. No. 3,000,167. As the bundle of filaments moves along its axis through the wrapping area, a ring circulates about the bundle carrying a roll of wrapping material which is applied to the bundle to form a spiral wrap pattern. Because the normal load of filaments or similar items is much longer than the wrapping area, it is not necessary to provide support for the bundle in the wrapping area and therefore no support structure is wrapped with the bundle.

Commercial circular rotating wrapping machines are presently manufactured by Lantech, Inc. under the trademark LANRINGER and are provided with wrapping ring inner diameters of 36 inches, 54 inches, 72 inches and 84 inches. In differentiating between the various circular rotating wrapping machines manufactured by Lantech, Inc., the manual model has the designation SR; the full web models have the designations SVR and SAVR; the multiple banding models have the designation SVBR and SAVBR; the spiral models have the designation SVSR and SAVSR and the continuous wrap or bundle models have the model designations SVCR and SAVCR.

In these commercial machines, the load is pushed onto support tongues or wrapping rails and the load and support tongues are wrapped by a rotating supply of film. The film is stretched as it is rotated from the dispenser and the stretched film wrap holds the load together under compressive forces and also engages the tongues or wrapping rails on which the load is supported. The load is then pushed off or carried off on the tongues by the following load or take-off conveyor respectively with the attendant frictional forces which result from the film engaging the tongues. Alternately the load as it is fed into the rotating wrapping apparatus is carried through the wrapping station by a conveyor assembly having an upper conveyor which carries the load in a downstream direction and a lower conveyor mounted under the load carrying conveyor. The lower portion of the endless belt of the lower conveyor travels at the same speed and in the same direction as the upper portion of the endless belt of the load carrying conveyor so that stretched film wrapped around the load and conveyor assembly is carried by the lower conveyor at the same speed and in the same direction as the load is carried by the upper conveyor. The wrapped load is transported to a take-off conveyor spaced from the conveyor assembly allowing the wrap to be transported off of the conveyor assembly to assume a memory position around the load before it is carried off by the take-off conveyor.

In the previously described circular bundling machines, the loads are wrapped with stretched film web and severed, leaving a package which is open ended at its leading and its trailing ends, thus, exposing the package to elements, spillage, damage and theft. While this problem can be overcome with the use of a wrapping machine downstream from the continuously wrapped loads which wraps the ends with another wrap, it can be seen that such a process is time-consuming and expensive, both from a materials usage and from a labor standpoint. This problem has been solved in several applications but unfortunately, these applications are not applicable to wrapping commercial loads in a manner shown in the present invention. One manner of solving this problem is through the use of a continuous tubing which is then stuffed with material. The tubing is then compressed at various intervals and the compressed portion of the tubing is sealed together by a heat seal mechanism as shown in U.S. Pat. No. 3,001,384 or tied together with a hog-ringer. In another embodiment, two overlapping layers of material are heat sealed around the package at their outer perimeter. Such a method of wrapping an article in plastic film is shown in U.S. Pat. No. 3,381,444.

One solution for large commercial load wrapping is shown in U.S. Pat. No. 3,902,303 in which a bag is placed over a commercial pallet load and then heat shrunk around the load to make the unitary package.

However, the prior art exhibits a widespread deficiency: a continuous wrap of stretch film web cannot be extended effectively between consecutive loads of varying circumferences. The maintenance of film web under tension between loads is especially desired so that severence of consecutive loads causes the severed film to collapse against load ends and provide containment force. For loads of circumferences greater than the width of the film web, a film tube short enough to be supported by consecutive loads alone, i.e. of length less than the film web width, cannot provide sufficient collapsed film when severed to cover both load ends. Further, and regardless of the width of the film or the length of the tube, when a film tube extends from a load of smaller circumference to a load of larger circumference, severence necessarily results in slack at the smaller load and inadequate coverage at the larger. It is the object of the present invention to provide an apparatus which spirally wraps consecutive loads carried by a conveyor, thereby forming a film tube between consecutive loads which is maintained under tension regardless of the relative sizes of consecutive loads. Thus, the present invention permits wrapping of consecutive customized items such as, for instance, rugs, of widely varying circumferences with subsequent severence causing collapse of film web against load ends to provide containment force and protection from exterior elements.

SUMMARY OF THE INVENTION

The present invention comprises a rotatable wrapping apparatus which wraps a stretched web of film around a load transported by a dual conveyor system and a plurality of flexible smooth surfaced members which extend from the frame of the wrapping mechanism downstream of the conveyor assembly. The flexible members engage the load which is being wrapped by the wrapping apparatus and a load which has been previously wrapped by the wrapping apparatus. The stretched film pulls the flexible members in toward each other in the space between the load to form a tube configuration of film. The narrowed film tube between the load wrapped already and the load being wrapped is engaged by a severing apparatus which severs and optionally seals the ends of the packages. The flexible members comprise a plurality of spring-like smooth surfaced members which slip from each wrapped load as the wrapped loads are transported by a take-off conveyor system to the stacking area.

The conveyor assembly holding the load and stretched film web eliminates friction problems which are inherent in the prior art wrapping systems and eliminates the need for changing the spacing required to accommodate the web angle formed between the load and the wrapping ring.

The present invention is especially well adapted to handle random size loads of varying length, composition and circumference without changing wrapping rail sizes or adjusting a mechanism. A film web tube of length sufficient to allow complete covering of consecutive load ends when severed is supported under tension sufficient to provide security and compression after severence and collapse. Moreover, because the flexible members rest on the circumference of both of each two consecutive loads, when the consecutive loads are of substantially different circumferences the tube becomes a shape of smoothly increasing or decreasing cross-section which permits subsequent severence and collapse to cover both load ends effectively.

The package which is obtained from the wrapped bundles is enclosed and held under a compressive force by the stretch wrapping around the package without the need or use of top or side sheets or a second wrapping machine.

Although the invention is set forth in the claims, the invention itself and the method by which is the made and used may be better understood by referring to the following description taken in connection with the accompanying drawings, forming a part hereof, in which like reference numerals refer to like parts throughout the several views, and in which:

DETAILED DESCRIPTION OF THE DRAWINGS

Figure 1:
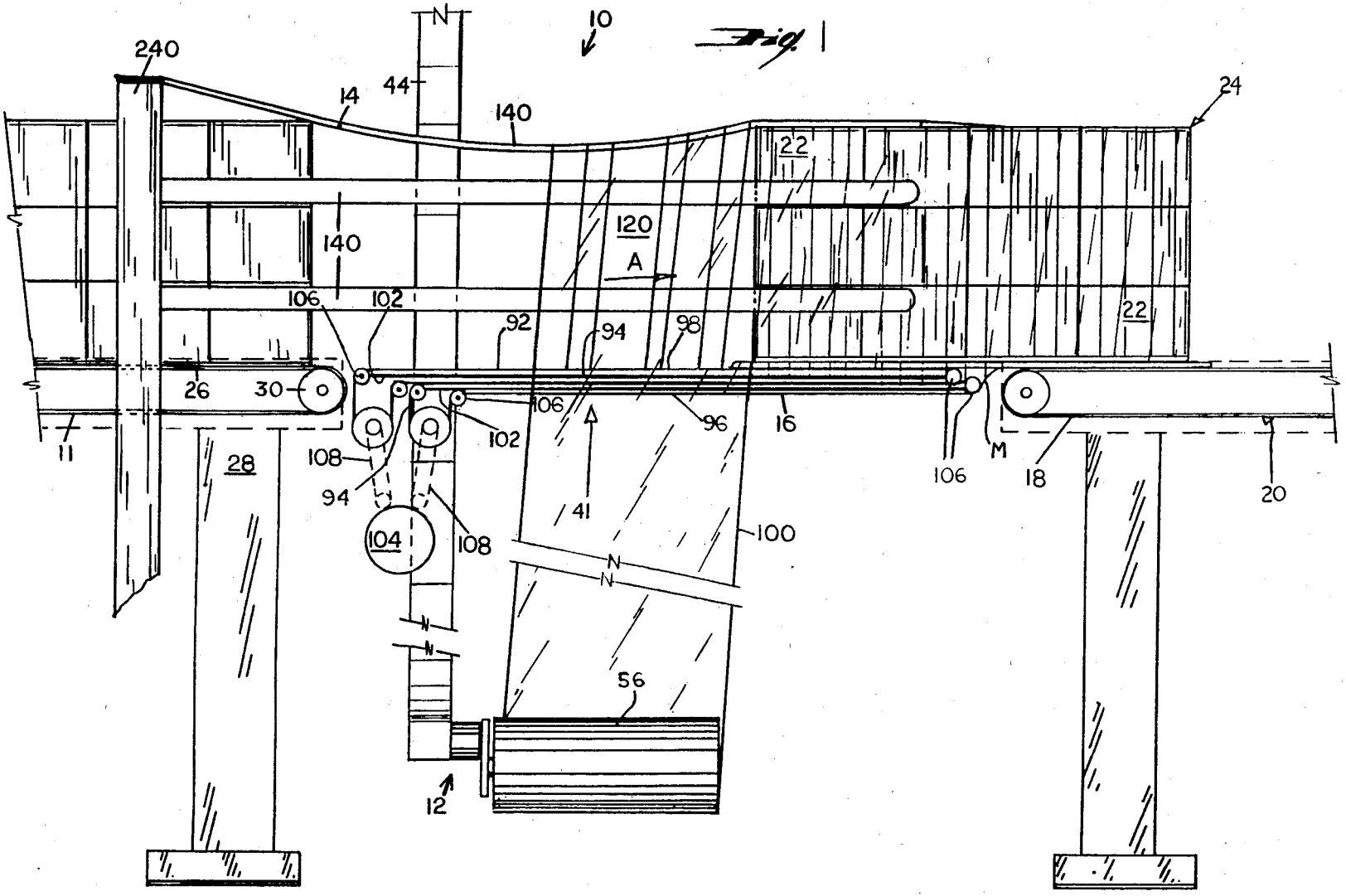
FIG. 1 discloses a side elevation view of the inventive apparatus with the double conveyor assembly to illustrate the flexible wrapping rails used in the inventive apparatus.
Figure 2:
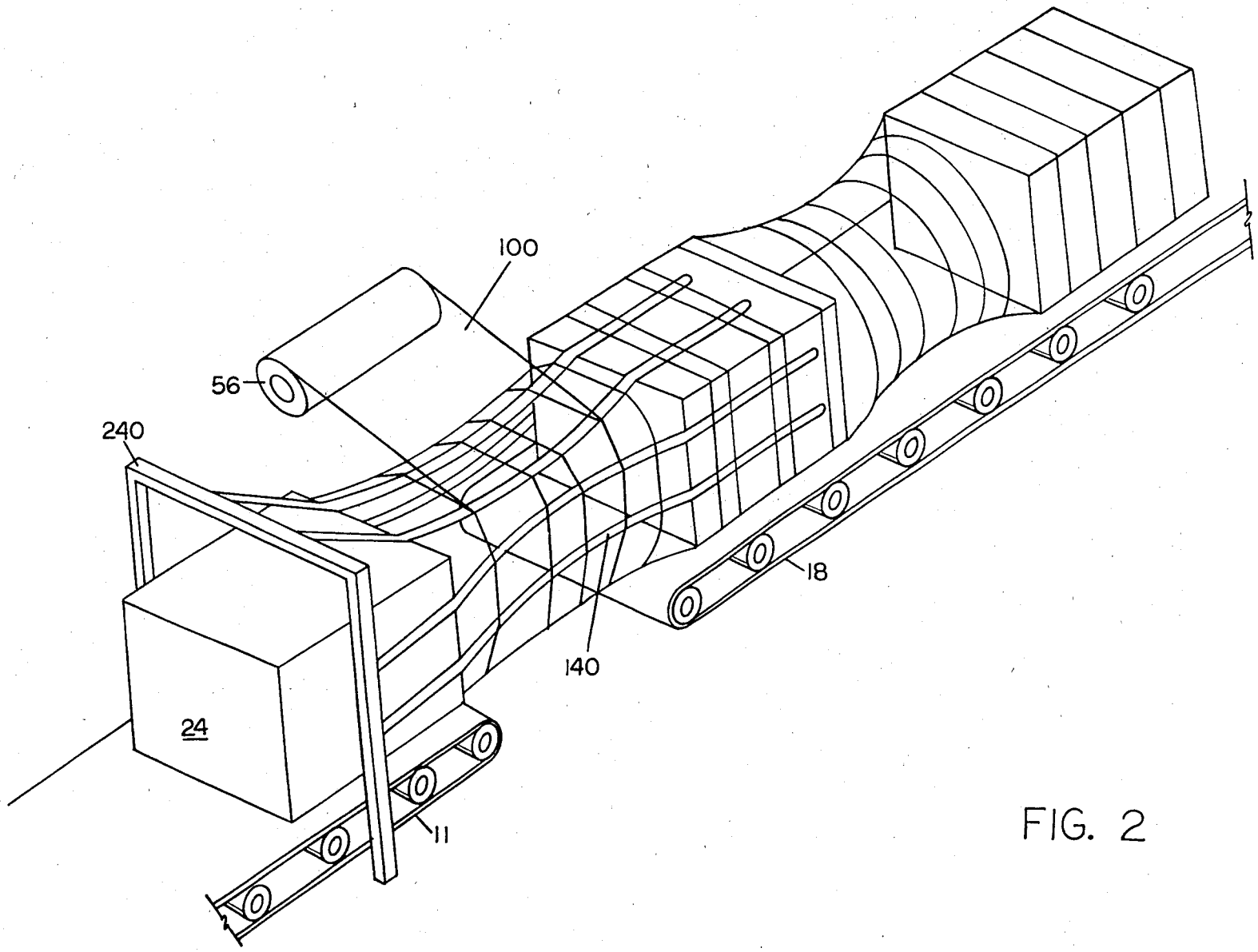
FIG. 2 is a perspective view of an alternate embodiment of the inventive apparatus with the wrapping apparatus deleted showing continuous spiral bundling type of wrap utilized on packages which have been continuously wrapped by the invention while supported on wrapping rails.
Figure 4:
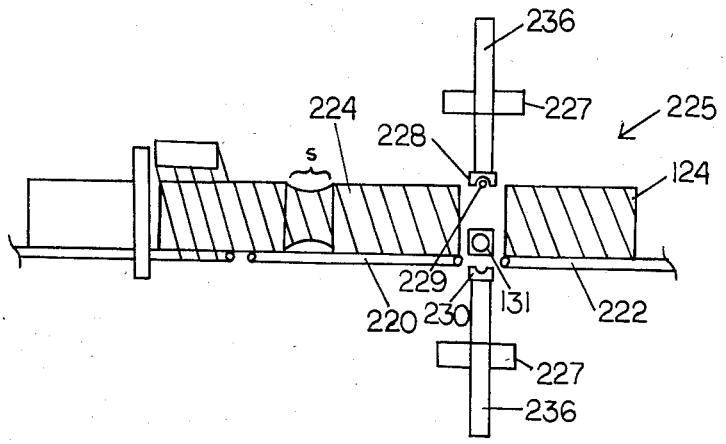
FIG. 4 discloses a side elevational view of the wrapping of the load and cutting and sealing of another load.
Figure 3:
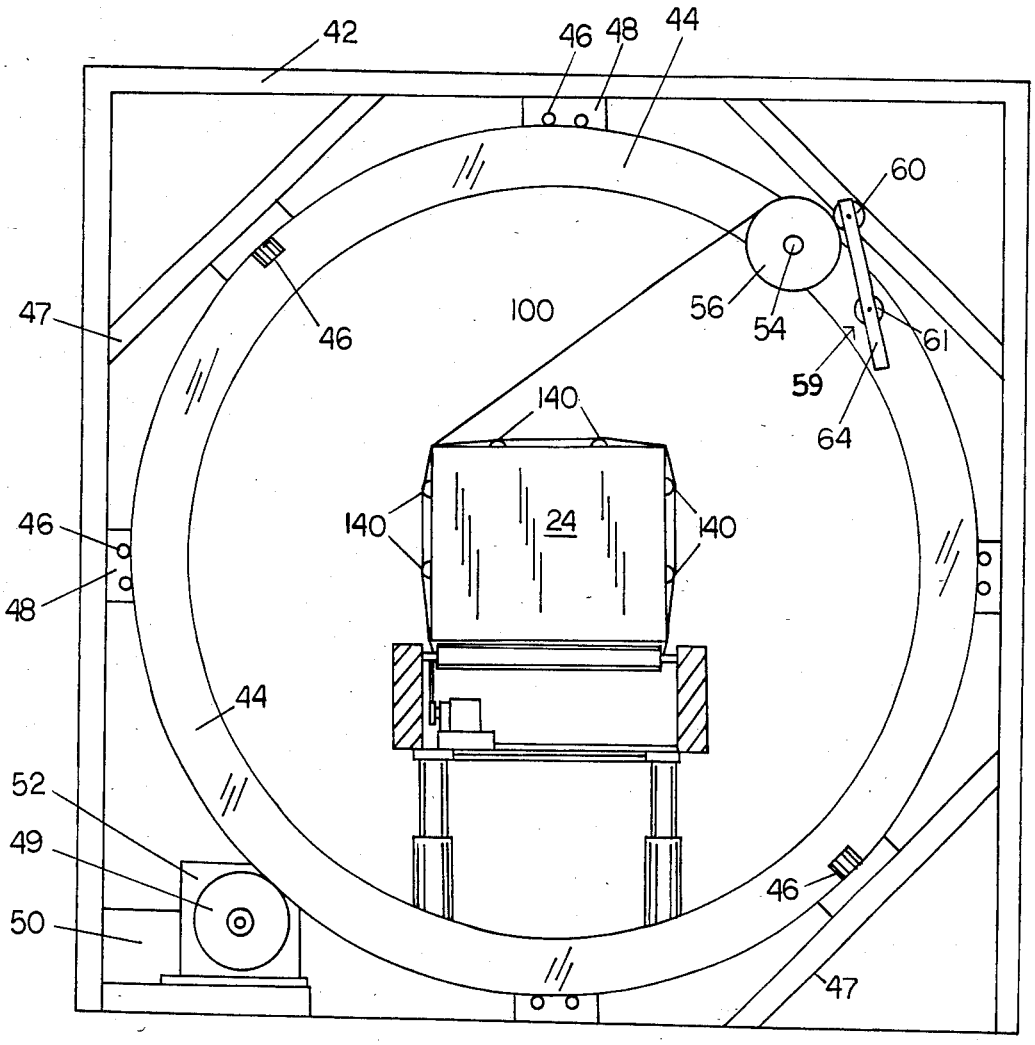
FIG. 3 is an enlarged rear elevational view of the ring wrapping apparatus invention shown in FIG. 1.

The best mode and preferred embodiment of the present invention, is disclosed in FIGS. 1 and 3 through 4, which shows a ring wrapping apparatus 10 comprising a film dispensing apparatus 12 provided with a necking assembly 14. A load 24 consisting of a plurality of stacked cartons 22 is carried into the wrapping area by a wrap and load carrying conveyor assembly 16, and through the wrapping area to a take-off conveyor 18 which leads to a sealing assembly 20.

As shown in FIG. 1, a plurality of cartons 22 forming a load 24 have been loaded in a stacked relationship on an infeed conveyor 11, by either manual or mechanical means. The mechanical means may be in the form of any one of a number of prior known types of stacking or placement devices which are well known in the art to stack or place a load into a designated area.

In the preferred embodiment, the load 24 is carried on an infeed conveyor 11 which comprises an endless belt 26 mounted on a frame support 28.

An alternate embodiment of the infeed conveyor could take the form of a hydraulic or pneumatic pushing device (not shown) which can be used to engage each load 24 with a platen to push the load into the wrapping area. However, the conveyor embodiment is preferred and the belts of the conveyor of the present invention are preferably textured so that they have a high coefficient of friction.

The conveyor belt 26 as seen in FIG. 1 is mounted on rollers 30 which are rotatably journalled by suitable bearing means and brackets which are secured to the frame support 28. The infeed conveyor 11 carries the loads 24 into a wrapping station 120 comprising film dispensing apparatus 12 and wrapping conveyor assembly 16.

The film dispensing apparatus 12 of the invention is shown in FIG. 3 and comprises a frame 42, on which a steel "donut" or ring shaped film support member 44 is rotatably mounted and supported on three planes by guide rollers 46. If desired, the film support member can be constructed of aluminum. The rollers 46 project inward from the frame 42 on arms 47 and mounting plates 48 to engage the ring-shaped member to be driven in a predetermined path. A friction drive-wheel 49 is positioned adjacent the ring member 44 at its base and engages the member 44 to rotate the member 44 within the guide wheel roller area. The friction drive-wheel 49 is driven by a motor 50 having a shaft which is suitably connected with the drive reducer 52. A material roll dispensing shaft 54 is rotatably secured to the ring member 44 for rotation on its axis and is adapted to receive and hold a roll of film material 56.

Typical films which can be used in the stretch wrapping apparatus are EVA copolymer films with a high EVA content such as the film manufactured by Consolidated Thermoplastics "RS-50", Bemis "Super-Tough" and PPD "Stay-Tight" films. PVC films such as Borden Resinite "PS-26" can be used in the invention along with premium films such as Mobil-X, Presto Premium and St. Regis, which utilize a low pressure polymerization process resin manufactured by Union Carbide and Dow Chemical Company. This resin, called linear low density polyethylene, has significantly different stretch characteristics than previous stretch films. These characteristics allow the film to withstand the high stress of extreme elongation without tearing during the wrapping of the load. Tacky film is preferred due to its self-adherence which contributes to tube formation between loads. However, non-tacky film may also be used with the present invention.

It should be noted that, "film", "film material" and "film web" are used interchangeably throughout the present specification.

In the preferred braking assembly used with the best mode of the invention and illustrated in FIG. 3, a film roll friction brake mechanism 59 is mounted to the ring-shaped member 44. The brake mechanism 59 engages the surface of the film roll 56 with a drag brake 60 mounted to support arm 64 to maintain constant tension of the surface of the roll. This constant tension allows the film web to cover the load with the desired degree of stretch provided on the film. Drag brake 60 is constantly urged against film roll 56, as the roll 56 pays out film and reduces diameter, by action of bias device 61 on arm 64. Bias device 61 may be a spring or other well-known component suited to this purpose. The leading edge of the web of stretchable material 100 is withdrawn from the roll 56 and is placed adjacent the initial load before tension is applied. However, if desired, the leading edge can be placed under initial tension.

An alternate but equally adaptable film stretching embodiment is shown in U.S. Pat. No. 4,302,920, which patent is incorporated herein by reference, can be used to stretch the film web. In this embodiment, the film web is passed through a prestretching assembly comprising a plurality of gear connected rollers. The gears are sized so that the film web will drive the downstream roller at a faster rate of speed than the upstream roller causing the film to be stretched between a narrow space between the two rollers. The prestretching assembly is pivotable so that the film may be threaded through the assembly and wrapped around the load in a substantially unelongated condition until such time as the first corner of the load is covered with unstretched film.

The tube support assembly 14 comprises a plurality of smooth surfaced flexible linear members 140 which are secured to a support frame 240 and extend downstream over the wrapping conveyor assembly 16 to the take-off conveyor 18. The linear members 140 are preferably constructed of a slippery plastic such as DELRON, a material made by duPont, or can be constructed of a smoothly polished stainless spring steel with memory. It is apparent that any suitable material which has a smooth surface which will allow plastic film to move over it without abrasion, tearing or substantial friction, and which is also tough and resilient and of a flexible nature can be used in the invention. While the length of the members 140 has been indicated as extending approximately out to the take-off conveyor 18, and is preferably longer than the width of the film web, it is only necessary that the members be of a sufficient length to extend to the wrapped load immediately preceding the load which is then being wrapped in the film dispensing assembly.

The wrapping conveyor assembly 16 as best seen in FIG. 1 comprises two stacked conveyors 92 and 94. These conveyors are standard plate-type conveyors well known in the art comprising driven endless belts 96 and 98 mounted on a plurality of rollers 106. The rollers are supported by plates 102 secured in turn to a frame member (not shown) which holds the rollers in a rotatable position. The endless belt 96 is rotated in a direction A shown by the arrow in FIG. 1 and travels at the same speed as endless belt 98. Both belts are driven by a motor assembly 104 shown in FIG. 1 which is connected by gear means (not shown) and linkage 108 in the form of chains or belts to drive the conveyors. The upper segment of conveyor 92 travels downstream with the lower segment traveling upstream. The upper segment of conveyor 94 travels upstream while the lower segment travels downstream.

This belt construction allows a web of film to be wrapped around a load 24 which was carried from the infeed conveyor 11 onto the wrapping station 120. The stretched wrap of web is wrapped around the flexible members 140 of the tube support assembly 14, the wrapping conveyor assembly 16 and the load with both the load and wrap being carried by the conveyor assembly in the same direction. The flexible members 140 allow a space having a given cross sectional area between the loads to be wrapped under tension and when the film between loads is severed and sealed, the film collapses against the ends of the load to complete the wrap.

When the load encounters the take-off conveyor 18 as shown in FIG. 1, the elongated stretched web coming off of the end of the conveyor assembly assumes its memory position M against the load in the space between the wrapping conveyor 16 and take-off conveyor 18, allowing the contained load covered by stretched wrap to be carried away.

Alternatively, wrapping conveyor 16 may extend throughout the assembly and take the place of either or both infeed conveyor 11 and take-off conveyor 18. The flexible members 140 may terminate downstream of the wrapping area 41 before, at or after the end of wrapping conveyor 16. The ends of the flexible members 140 slip out from between the load and the encircled film web as the load is transported past the ends of the flexible members 140. The film web then collapses against the side and top surfaces of the load.

The spiral wrapped bundle 224 as seen in FIG. 4 is severed into individual packages by a guillotine-like cutting apparatus 225 comprising a frame 227, two parallel bars 228 and 230 and a cutter wire 229 mounted to one of the bars. The cutter wire 229 consists of a nichrome wire which is electrically connected to a source of energy. The resistance of the wire causes sufficient heat so that when the wire is reciprocated with the bars between the bundles 224, the wrap is severed forming encapulated loads 124. The film material may also be simultaneously bonded at each edge by, for example heat applied through the bars, so that the forward edge of one load is sealed as the rearward edge of the preceding load is sealed. As the spiral bundle 224 enters the cutting area, sensor 131 projects a light source through the transparent film in a space S between the individual loads against a photoelectric reflector (not shown) to generate an electrical signal commanding the bar drive circuitry to activate pneumatic cylinders 236 driving together the sealer bars 228 and 230. The cutter wire 229 is activated to cut through the film after the film has been clamped between the bars to sever the load 124 from the wrapped spiral bundle 224. Such sensing apparatus are well known in the art, and any standard circuit can be used to cause the pneumatic cylinders 236 to be activated when the sensor means senses a space between loads 124. Likewise, a limit switch, contact switch, pressure sensitive switch or other suitable means can be used to activate the cylinders 236. In operation, the bars are driven toward each other during the seal and cut and driven away from each other above and below the load surface for the next seal and cut to provide smooth, efficient operation.

The spiral bundle advances and the next spacing S between the loads 124 is sensed by the light sensor 131. The sealing bars which have been previously driven away from each other allowing the loads to be transported are driven toward each other severing the wrapped loads in the same manner as previously discussed.

In the foregoing description, the invention has been described with reference to a particular preferred embodiment, although it is to be understood that the specific details shown are merely illustrative and that the invention may be carried out in other ways without departing from the true spirit and scope of the following claims.

What is claimed is:

1. Apparatus for continuously wrapping consecutive loads of varying sizes and unitizing the loads into wrapped packages comprising conveyor means adapted to receive a plurality of loads spaced apart, wrapping means positioned adjacent said conveyor means, said wrapping means comprising a frame, a roll dispenser means rotatably mounted on said frame, and conveying means axially aligned to receive said loads from said conveyor means and support said loads, a plurality of flexible support members mounted to said frame and extending downstream from said frame to a wrapped load, said roll dispenser means being adapted to hold a roll of film material and wrap said material across said support members, said conveying means, each said load and the space between adjacent loads, thereby forming the material into tubes wrapped around space between each load in said wrapping means and the downstream wrapped load, said tubes extending between the consecutive loads and connecting said consecutive loads, drive means connected to said roll dispenser means to drive said roll dispenser means so that it deposits material across said support members and loads, and film stretching means mounted to said roll dispenser means, said film stretching means being adapted to engage the film material substantially stretching and tensioning the film material being dispensed from said roll to form said tube under tension against said consecutive loads and said flexible members; means positioned downstream from said conveying means adapted to carry said loads and said tensioned tube connecting consecutive loads away from said wrapping means to a package severing station.

2. Apparatus for continuously wrapping a plurality of consecutive loads of varying cross-sectional sizes with a continuous wrap and unitizing the loads into wrapped enclosed packages comprising conveyor means adapted to receive the plurality of loads, wrapping means positioned adjacent said conveyor means, said wrapping means comprising a frame, film dispenser means rotatably mounted on said frame, a wrap conveyor means positioned within a wrapping area defined by rotation of said film dispenser means and aligned with said conveyor means to receive said loads from said conveyor means and carry said loads spaced apart through said film dispenser means, film support means mounted to said frame, said film support means extending from said frame downstream through and past the wrapping area to sides of a wrapped load downstream from the wrapping area, said film support means comprising a plurality of bendable flexible members, said film dispenser means being adapted to hold a roll of film material and continuously wrap said film material across each of the loads, said flexible members and said wrap conveyor means, drive means connected to said film dispenser means to drive said film dispenser means continuously to dispense film material across said flexible members, wrap conveyor means and loads, and film stretching means mounted to said film dispenser means, said film stretching means being adapted to engage the film material carried by said film dispenser means and substantially stretch and tension said film material as it is being dispensed so that said tensioned film material continuously forms a tube extending around and between each two consecutive loads and around said film support means, take-off conveyor means positioned adjacent said wrap conveyor means adapted to convey said continuously wrapped plurality of loads spaced apart, and a unitizing station comprising heat sealing means and cutting means adapted to sever the film material between loads so that each load is enclosed with a stretched film wrap holding it in a compressed wrapped package.

3. Apparatus as claimed in claim 2 wherein said flexible members comprise a plurality of smooth surfaced flexible members.

4. Apparatus as claimed in claim 3 wherein said flexible members are DELRON.

5. Apparatus as claimed in claim 3 wherein said flexible members are spring stainless steel.

6. Apparatus as claimed in claim 3 wherein said flexible members are plastic.

7. Apparatus as claimed in claim 2 wherein said sealing means comprises a plurality of heat sealer bars.

8. Apparatus as claimed in claim 3 wherein said flexible members are rod shaped.

9. Apparatus as claimed in claim 2 wherein said cutting means comprises a heated nichrome wire.

10. Apparatus as claimed in claim 2 wherein film stretching means comprises at least two spaced apart roller members connected so that the downstream roller member transports the film web faster than the upstream roller member to cause the film material to elongate between the roller members before it reaches the load.

11. Apparatus as claimed in claim 2 wherein said film stretching means comprises brake means mounted on said film dispenser means to restrict the film web.

12. Apparatus for consecutively wrapping a plurality of spaced loads of varying sizes and unitizing the loads into separate enclosed wrapped packages comprising a conveyor assembly adapted to receive a plurality of loads, a wrapping means positioned adjacent said conveyor assembly, said wrapping means comprising a frame and a film dispensing means rotatably mounted on said frame, said film dispensing means when rotated defining a wrapping area, said film dispensing means being adapted to hold a roll of film material and wrap film material around loads passing through the wrapping area, said conveyor assembly comprising at least two conveyor means driven at substantially the same speed, a first one of said conveyor means being adapted to receive a load and transport said load, a second one of said conveyor means being adapted to be wrapped with film dispensed from said film dispensing means so that the wrapped load on the first one of said conveyor means and film web wrapped around the second one of said conveyor means are carried by both conveyor means at substantially the same speed, film support means mounted to said frame, said film support means comprising a plurality of flexible members extending downstream from said frame into and across the space between two consecutive loads, thereby providing support for film web formed into a tube between consecutive loads, drive means connected to said film dispensing means to drive said film dispensing means, and film stretching means mounted to said film dispensing means engaging said film to substantially stretch and tension the film being dispensed from said film dispensing means to form said tube under tension against said consecutive loads and said flexible members.

13. Apparatus as claimed in claim 12 wherein said film stretching means comprises brake means mounted to said film dispensing means, said brake means being adapted to engage the outer surface of said roll of film material mounted on said film dispensing means to place tension on said roll stretching the material being dispensed from said roll onto said load.

14. Apparatus as claimed in claim 12 wherein said film stretching means is mounted to said film dispensing means and comprises at least two connected and spaced apart rollers driven so that a downstream roller transports the film faster than an upstream roller to cause the film to elongate between the rollers before it reaches the load.

15. Apparatus as claimed in claim 14 wherein said connected and spaced apart rollers are interconnected by gear means.

16. Apparatus as claimed in claim 12 wherein said flexible members are DELRON.

17. Apparatus as claimed in claim 12 wherein said flexible members are bendable linear stainless steel.

18. Apparatus as claimed in claim 12 wherein said flexible members are long smooth surfaced planar rods.

* * * * *